US005110544A

United States Patent [19]

Sato et al.

[11] Patent Number: 5,110,544

[45] Date of Patent: May 5, 1992

[54] STAINLESS STEEL EXHIBITING EXCELLENT ANTICORROSION PROPERTY FOR USE IN ENGINE EXHAUST SYSTEMS

[75] Inventors: Eiji Sato; Ryo Matsuhashi; Satoshi Ito, all of Kanagawaken; Kazuhiro Tano; Kenichi Asakawa, both of Kitakyusyuhi, all of Japan

[73] Assignee: Nippon Steel Corporation, Tokyo, Japan

[21] Appl. No.: 618,948

[22] Filed: Nov. 27, 1990

[30] Foreign Application Priority Data

Nov. 29, 1989 [JP] Japan ..... 1-309476

[51] Int. Cl.[5] ..... C22C 38/22; C22C 38/26

[52] U.S. Cl. ..... 420/69; 420/40; 420/68

[58] Field of Search ..... 420/40, 68, 69

[56] References Cited

U.S. PATENT DOCUMENTS 4,652,428 3/1987 Maruhashi et al. ..... 420/68

FOREIGN PATENT DOCUMENTS 53-118218 10/1978 Japan ..... 420/40

54-71026 6/1979 Japan ..... 420/40

*Primary Examiner*—Deborah Yee

*Attorney, Agent, or Firm*—Wenderoth, Lind & Ponack

[57] ABSTRACT

A stainless steel exhibiting excellent anticorrosion property for use in engine exhaust systems comprises not more than 0.010% C, not more than 0.2% Si, 0.05%-1.5% Mn, 12%-20% Cr, 0.2%-3.0% Mo, 0.005%-0.1% Al, not more than 0.015% N, not more than 0.025% P, not more than 0.010% S, either or both of 10×(C %+N %)−0.5% Ti and 5×(C %+N %) 0.5% Nb, and the balance of Fe and unavoidable impurities. An additional improvement in the anticorrosion property of the stainless steel can be obtained by further adding thereto one or more of 0.1%-1.0% Ni, 0.03%-1.0% Cu, 0.05%-0.5% W, 0.05%-0.5% V and 0.05%-1.0% Zr and/or one or both of 0.001%-0.03% Ca and 0.001%-0.03% Ce.

9 Claims, 1 Drawing Sheet

STAINLESS STEEL EXHIBITING EXCELLENT ANTICORROSION PROPERTY FOR USE IN ENGINE EXHAUST SYSTEMS

BACKGROUND OF THE INVENTION

1. Field of the Invention

This invention relates to a stainless steel exhibiting excellent anticorrosion and pitting prevention property in the wet gas and exhaust condensate produced in the muffler and associated pipes (hereinafter collectively referred to simply as the muffler) for emission of the exhaust gas produced in the engines of automobiles, motorcycles and the like.

2. Description of the Prior Art

In automobiles, motorcycles and the like, the high-temperature exhaust gas produced in the engine passes through an exhaust manifold, a catalytic converter, etc., a center pipe, a muffler and a tail pipe to the exterior of the exhaust system. As the temperature of the muffler is low at the time the engine is started, moisture contained in the exhaust gas condenses and the condensate adheres to the inner wall and pools on the floor of the muffler. Since this condensate contains the $CO_3^{--}$, $NH_4^+$, $SO_4^{--}$ and $NO_3^-$ components of the exhaust gas as well as $Cl^-$ and small amounts of organic substances, it has an adverse effect on the corrosion resistance of the muffler. During engine operation, since the temperature of the muffler rises with increasing temperature of the exhaust gas, the ammonia and the like contained in the condensate vaporize, causing the pH of the condensate to change from alkaline to acidic. For producing mufflers appropriate for such an environment, the practice has been to use Al-coated steel sheet or steel sheet containing Cr.

However, since the increasing severity of exhaust emission regulations in recent years has led to diversification in muffler use conditions, mufflers fabricated of the aforesaid steel sheet materials are no longer able to provide adequate corrosion resistance and consequently have relatively short service lives. A demand has thus arisen for corrosion resistant materials capable of increasing automobile safety while also extending muffler service life. In response to this demand, Japanese Patent Public Disclosures No. 63(1988)-143240 and 63(1988)-143241 propose steels containing 5 to 10% Cr, but even such steels are unable to meet recent needs for extended service life.

SUMMARY OF THE INVENTION

An object of this invention is to provide a stainless steel exhibiting excellent anticorrosion property for use in the engine exhaust systems of automobiles and motorcycles.

Another object of this invention is to provide such a stainless steel developed by conducting a detailed analysis of the specific conditions under which mufflers are actually used (analysis of the types of corrosion, environmental conditions and the like) and conducting a study on the effects exerted under the so-elucidated corrosion environment conditions by the main components of stainless steel, Cr, Mo, Ti and Nb, and the effects exerted individually and in combination by Ni, Cu, W, V, Zr, Ca, Ce on anticorrosion property (pitting prevention property; hereinafter referred to simply as anticorrosion property), thus elucidating the effects of the respective elements and enabling realization of a low-strength stainless steel exhibiting good workability which when applied to actual mufflers exhibits excellent anticorrosion property and enables long service life, safety, prevention of environmental pollution and the like over long periods of time and which further enables use of pipe production equipment employing the process for ordinary steel production.

For achieving these objects, the inventors conducted research toward the development of a stainless steel for mufflers exhibiting markedly better anticorrosion property and workability than conventionally available muffler materials and, as a result of their work, discovered that these objects can be realized by application of the following knowledge:

(1) The state of corrosion of a muffler exposed to exhaust gas condensate under an actual operating environment becomes increasingly local with increasing Cr content of the steel sheet from which it is fabricated. In the laboratory, therefore, it is necessary to take this point into consideration in selecting the method of evaluation.

(2) For developing a muffler material exhibiting a long service life under severe environmental conditions, the inventors conducted a study using mufflers that had actually been used in driving in various regions. As a result they learned that there are two causes for the development of corrosion holes in mufflers: (1) pitting of the base metal and (2) intergranular corrosion. SUH409, SUS430LX and SUS436L were found to fall in the first category, while intergranular corrosion was found to occur in SUS409 welds and in the welds of SUS430LX and SUS436L having a Ti/(C+N) value of less than 10 and a Nb/(C+N) value of less than 5. It was further discovered that the cause of the intergranular corrosion is the deficiency of Cr in the vicinity of $Cr_{23}C_6$ precipitated at the grain boundaries during weld cooling.

Based on this study and the results of research into the corrosion resistance of various alloys, the inventors completed this invention taking into account the facts that the base metal requires a Cr content of not less than 12%, that a Ti/(C+N) value of not less than 10 and a Nb/(C+N) value of not less than 5 are required for preventing precipitation of $Cr_{23}C_6$ at welded portions, and that for ensuring improved workability during and after pipe making it is advisable to reduce the Si content for suppressing hardening due to solid solution Si as much as possible and to hold the Ti and Nb contents to the minimum levels necessary for prevention of intergranular corrosion so as not to degrade the workability or secondary workability, and to hold the recrystallization temperature as low as possible, thereby enabling a production volume which makes it possible to employ a production line for ordinary steel.

In view of the foregoing, the stainless steel exhibiting excellent anticorrosion property and excellent workability for use in engine exhaust systems according to this invention has a basic composition including in combination 12-20.0% Cr and 0.2-3.0% Mo and additionally including either or both of $5\times(C\%+N\%)$-0.5% Nb and $10\times(C\%+N\%)$-0.5% Ti, the remainder being substantially Fe and unavoidable impurities. For providing even further enhanced anticorrosion property, it may additionally comprise one or more of 0.1-1.0% Ni, 0.03-1.0% Cu, 0.05-0.5% W, 0.05-0.5% V and 0.05-1.0% Zr.

Moreover, in order to inhibit the generation of MnS type inclusions which may act as starting points for pitting, the stainless steel exhibiting excellent anticorrosion property in an engine exhaust gas according to this invention may, for improving its anticorrosive property, include either or both of 0.001% -0.03% Ca and 0.001% -0.03% Ce.

The above and other features of the present invention will become apparent from the following description made with reference to the drawings.

DETAILED DESCRIPTION OF THE PREFERRED EMBODIMENT

Figures 1A, 1B:
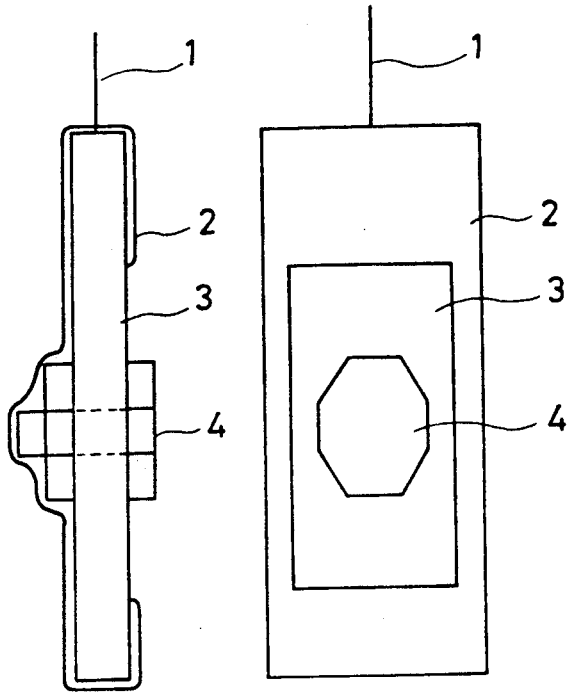
FIG. 1(*a*) is a side view of a specimen subjected to an electrochemical pitting initiation evaluation test and FIG. 1(*b*) is a front view of the same.

In analyzing the corrosion behavior of stainless steel in a muffler environment for the purpose of developing a material suitable for such an environment, it is necessary to chemically analyze the environment within the muffler so as to clarify the environmental factors which affect the corrosion behavior of the stainless steel, and for this it is necessary to carry out corrosion evaluation in a test environment simulating the actual environment.

The inventors therefore chemically analyzed exhaust gas condensate and deposits (corrosion products) collected from various locations inside a muffler and, based on the results of this analysis, established a simulated exhaust gas condensate. Regarding the corrosion behavior within the muffler, it was further found that, differently from the case of an Al-coated steel which experiences general corrosion, a Cr-containing steel sheet tends to incur localized corrosion (pitting) and this tendency increases with increasing Cr content. The fact that the corrosion mode becomes increasingly localized with higher Cr content of the steel makes it important to evaluate the pitting property.

Based on the results of their analysis, the inventors therefore imitated the exhaust gas condensate environment by mixture and adjustment of prescribed amounts of sulfate ions (5000 ppm), carbonate ions (3000 ppm), chloride ions (1000 ppm), nitrate ions (100 ppm) and formic acid (100 ppm) to obtain a simulated condensate environment.

Using this simulated environment, an electrochemical evaluation method to be explained later was carried out on steels containing 12 to 20% Cr and having Mo contents varied between 0.2 and 3% Mo, and on the aforesaid steels further containing various amounts of Ti, Nb, Ni, Cu, W, V, Zr, Ca and Ce. By multiple regression analysis of the dependency of the so-obtained pitting property values (pitting initiation property value: $E_I$) on the respective alloying elements (the pitting initiation property value $E_I$ being defined in the form of alloying element dependency as $E_I = A + B \cdot C_I$), there was newly obtained, as an index indicating the alloying element dependency with respect to pitting initiation inhibition, the relationship $C_I$ value = Cr + 2.0 Mo. Based on this relation, a $C_I$ value of 12.4–24.5 was set for an alloy system having a pitting initiation potential higher than that of the comparison steels (Nos. 22, 23, 24) shown in Table 1.

Another property required of a stainless steel muffler material in addition to that of being highly resistant to initiation of pitting is that of exhibiting a low rate of pitting propagation in the thickness direction of the sheet once pitting initiates. For evaluating this property, steels similar to the comparison steels but having different Cr and Mo contents, and the aforesaid steels further added with Ti, Nb, Ni, Cu, W, V, Zr, Ca, Ce, were immersed in the aforesaid simulated condensate for a prescribe period of time, whereafter the depth to which pitting had propagated from the specimen surface was determined. The results are shown in Table 1.

The reasons for the limits placed on the components of the muffler material will now be explained.

C: As carbon precipitates as $Cr_{23}C_6$ at the grain boundaries of the welded portions and becomes a cause for intergranular corrosion, its content should be kept low. While the C content should also be kept low for obtaining a base metal of preferable strength, workability and toughness, this leads to increased steelmaking time and cost. Notwithstanding, for providing the improved anticorrosion property and workability which characterize this invention, the C content is particularly limited to the extremely low level of not more than 0.010%.

Si: The deoxidation effect of silicon is not manifested at a content of less than 0.01%, while the workability of the steel suffers pronounced degradation when the content exceeds 0.8%. In consideration of surface processability and workability, the Si content is preferably not more than 0.2% and is therefore set at not more than 0.2%.

Mn: Although manganese does not exhibit a special effect on the anticorrosion property in an exhaust gas condensate atmosphere, its content is prescribed at the ordinary rate of not less than 0.05% and not more than 1.5%.

Cr: Chromium is a basic component of the stainless steel according to this invention. Where the stainless steel is to be used in an environment containing exhaust gas condensate or other such environment requiring it to have high corrosion resistance, the Cr content is required to be at least 12% when used together with Mo and, if necessary, also with Ni and Cu. Although the anticorrosion property and oxidation resistance increase with increasing Cr content, the anticorrosion property is saturated when the content exceeds 20%. A content higher than this level is also economically disadvantageous because it makes it more difficult to manufacture the stainless steel strictly to specifications.

Mo: Molybdenum, which is added conjointly with Cr and, if required, also with Ni, Cu and the like, is a required element for inhibiting the initiation and propagation of pitting. It exhibits a particularly good effect at a content of not less than 0.2% and not more than 3.0% when present together with Cr and the other elements set out in the claims (hereinafter referred to as the "other elements"). A content of less than 0.2% does not provide sufficient anticorrosion property, while the small contribution to anticorrosion property by additions in excess of 3.0% is not commensurate with the increase in cost.

Al: Aluminum is added as a deoxidant in an amount not exceeding 0.1%. When present at a level higher than 0.1% it degrades the anticorrosion property and the hot workability. On the other hand, it is ineffective at a content of less than 0.005%.

N: As nitrogen is an element which degrades the anticorrosion property of stainless steel, its content should be reduced as far as possible. It is therefore prescribed as being present at not more than 0.015%.

P: Phosphorus has an adverse effect on the anticorrosive property of stainless steel in an exhaust gas condensate atmosphere and its content should be reduced as far as possible. It particularly degrades the anticorrosion property at levels exceeding 0.025%.

S: Sulfur is an element having an adverse effect on the anticorrosive property of the stainless steel in an exhaust gas condensate atmosphere and its content should be reduced as far as possible. Its upper limit is therefore prescribed as being 0.010%.

Ti: Titanium prevents degradation of the anticorrosive property of the stainless steel by fixing C and N. When present together with Ca, it fixes O, inhibits the formation of Si and Mn oxides and improves the hot workability and anticorrosion property. It degrades the hot workability when present at more than 0.5%. Since it was found from an investigation of mufflers actually used for driving and from the results of an evaluation of intergranular corrosion resistance that a content of not less than $10\times(C\%+N\%)$ is required, this was set as the lower limit.

Nb: Niobium prevents degradation of the anticorrosive property of the stainless steel by fixing C and N. It degrades the hot workability at a content exceeding 0.5%. As it was found from the results of an evaluation of intergranular corrosion resistance that a Nb content of not less than $5\times(C\%+N\%)$ is required, this was set as the lower limit.

Ni: Nickel is an optional component of the stainless steel according to the present invention. In a stainless steel for use in an environment including exhaust gas condensate or in other such environments requiring high anticorrosion property, it is added together with Cr, Mo and the other elements. While it exhibits an inhibiting effect on pitting propagation, this effect is not manifested at contents lower than 0.1% and is saturated at contents exceeding 1.0%. Moreover, its addition to over 1.0% is uneconomical.

Cu: Copper is added to the Cr- and Mo-based component system to be present together with Ni and the other elements and is an element incorporated for enhancing the anticorrosive property in an atmosphere including exhaust gas condensate. The effect of its coexistence is pronounced at a content of not less than 0.03% but at a content exceeding 1.0%, its effect toward improving anticorrosion property is saturated and its presence at such a level moreover degrades hot workability.

W: As coexistence of tungsten in the stainless steel improves its corrosion and pitting resistance, this element is added as required at a level not exceeding 0.5%. It exhibits no effect at a content of less than 0.05% and its effect is saturated at a content exceeding 0.5%.

V: As coexistence of vanadium in the stainless steel improves its corrosion and pitting resistance, this element is added as required at a level not exceeding 0.5%. It exhibits no effect at a content of less than 0.05% and its effect is saturated at a content exceeding 0.5%.

Zr: As coexistence of zirconium in the stainless steel improves its corrosion and pitting resistance, this element is added as required at a level not exceeding 1.0%. It exhibits no effect at a content of less than 0.05% and its effect is saturated at contents exceeding 1.0%.

Ca, Ce: When present together with Al in low-sulfur steel, calcium and cerium enhance the anticorrosion property by fixing O and thus suppressing the formation of MnS type inclusions which may act as starting points for pitting. One or both of these elements are added as required within the range of 0.001–0.03%.

WORKING EXAMPLES

The stainless steel exhibiting excellent anticorrosion property for use in engine exhaust systems according to this invention will now be explained with reference to working examples.

EXAMPLE 1

Table 1 shows the chemical compositions of steels according to the invention and of comparison steels. The steels according to the invention having the chemical compositions shown in Table 1 were produced using a conventional vacuum melting furnace. After ingoting, each steel was hot rolled under conventional heating conditions, appropriately heat treated and then subjected to testing.

The pitting initiation potentials indicated in Table 1 are the values obtained in an electrochemical pitting initiation evaluation test (A). The larger the value, the greater is the resistance to the initiation of pitting.

Figure 2:
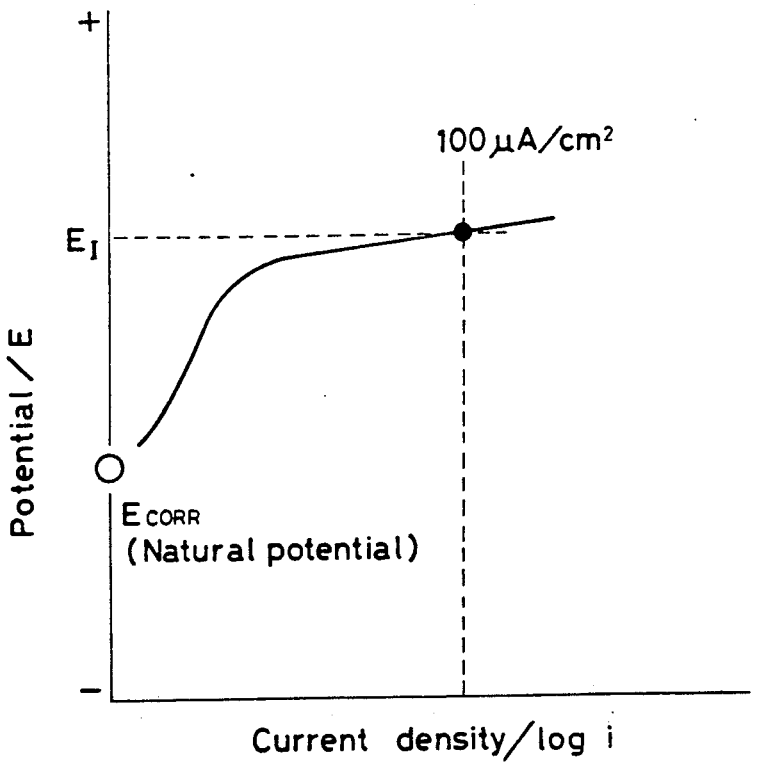
FIG. 2 is a graph for explaining the method of the electrochemical pitting initiation evaluation test.

The pitting initiation test (A) was conducted using a pitting test specimen as shown in FIG. 1. In FIG. 1, reference numeral 1 designates a lead wire, 2 the sealed portion of the specimen surface (the portion other than the test surface), 3 the test surface and 4 a polycarbonate bolt/nut. This arrangement enabled the pitting initiation rate to be increased by deliberately providing a gap in the test surface. The specimen was placed in a simulated exhaust gas condensate environment and, as shown in FIG. 2, the specimen was anodically polarized at a scanning rate of 20 mV/min from the naturally corroding potential ($E_{Corr}$). The potential at which the current density reached 100 $\mu A/cm^2$ was defined as the pitting initiation potential. The higher the value of this potential, the greater is the tendency for the steel to resist the initiation of pitting.

A pitting depth test (B) was conducted in a simulated exhaust gas condensate using a specimen 50 mm in width, 60 mm in length and 1.2 mm in thickness, which was subjected to #320 surface polishing and degreasing. As the test environment, a simulated exhaust condensate was employed with mixture and adjustment of prescribed amounts of sulfate ions (5000 ppm), carbonate ions (3000 ppm), chloride ions (1000 ppm), nitrate ions (100 ppm) and formic acid (100 ppm). The test was conducted by standing the specimen in a 200 cc glass beaker while pouring 100 cc of the condensate into the beaker so as to immerse half the length of the specimen. Over a 30-day period thereafter the beaker was maintained alternately in a boiling condition for 2 hours and in a steady state for 24 hours. At the end of the 30 days, the depth of all pits observed in the specimen were measured, among which the maximum depth was employed for the specimen evaluation.

TABLE 1

(wt %)

| | C | Si | Mn | P | S | Cr | Mo | Al | N | Ti | Nb | Ni | Cu | W |
|---|---|---|---|---|---|---|---|---|---|---|---|---|---|---|

TABLE 1-continued

| | | | | | | | | | | | | | | | |
|---|---|---|---|---|---|---|---|---|---|---|---|---|---|---|---|
| Invention | 1 | 0.010 | 0.19 | 0.95 | 0.015 | 0.005 | 12.5 | 1.2 | 0.03 | 0.007 | — | 0.15 | — | — | — |
| | 2 | 0.010 | 0.20 | 0.89 | 0.013 | 0.003 | 12.0 | 1.15 | 0.031 | 0.006 | — | 0.17 | — | — | — |
| | 3 | 0.010 | 0.20 | 0.95 | 0.012 | 0.005 | 16.5 | 1.17 | 0.029 | 0.005 | — | 0.19 | — | — | — |
| | 4 | 0.010 | 0.20 | 0.97 | 0.011 | 0.003 | 18.5 | 1.21 | 0.021 | 0.006 | — | 0.15 | — | — | — |
| | 5 | 0.010 | 0.20 | 1.01 | 0.012 | 0.002 | 17.0 | 1.20 | 0.020 | 0.003 | 0.25 | — | — | — | — |
| | 6 | 0.010 | 0.20 | 1.02 | 0.010 | 0.003 | 16.6 | 1.15 | 0.019 | 0.002 | 0.40 | — | — | — | — |
| | 7 | 0.009 | 0.20 | 0.89 | 0.011 | 0.003 | 16.7 | 1.22 | 0.020 | 0.003 | 0.35 | 0.15 | — | — | — |
| | 8 | 0.010 | 0.20 | 0.95 | 0.012 | 0.003 | 16.5 | 1.23 | 0.021 | 0.003 | 0.32 | — | 0.52 | — | — |
| | 9 | 0.010 | 0.20 | 0.95 | 0.013 | 0.003 | 16.7 | 1.30 | 0.021 | 0.003 | 0.31 | — | — | 0.31 | — |
| | 10 | 0.010 | 0.20 | 0.97 | 0.012 | 0.002 | 16.5 | 1.20 | 0.022 | 0.003 | 0.29 | — | — | — | 0.32 |
| | 11 | 0.010 | 0.20 | 0.95 | 0.013 | 0.003 | 16.7 | 1.21 | 0.020 | 0.003 | 0.30 | — | — | — | — |
| | 12 | 0.010 | 0.20 | 0.95 | 0.012 | 0.003 | 16.5 | 1.25 | 0.019 | 0.002 | 0.29 | — | — | — | — |
| | 13 | 0.010 | 0.20 | 0.95 | 0.012 | 0.003 | 16.3 | 1.35 | 0.019 | 0.002 | 0.30 | 0.19 | 0.51 | 0.31 | — |
| | 14 | 0.010 | 0.20 | 0.98 | 0.011 | 0.004 | 16.2 | 1.21 | 0.018 | 0.003 | 0.35 | 0.21 | 0.52 | — | — |
| | 15 | 0.010 | 0.20 | 0.97 | 0.011 | 0.004 | 17.1 | 1.21 | 0.020 | 0.003 | 0.32 | 0.18 | — | — | — |
| | 16 | 0.010 | 0.20 | 0.98 | 0.011 | 0.004 | 12.7 | 1.50 | 0.021 | 0.003 | 0.35 | — | — | — | — |
| | 17 | 0.010 | 0.20 | 0.98 | 0.011 | 0.003 | 17.9 | 1.35 | 0.022 | 0.003 | 0.32 | — | — | — | — |
| | 18 | 0.010 | 0.20 | 0.98 | 0.012 | 0.004 | 16.5 | 1.40 | 0.021 | 0.004 | 0.35 | 0.15 | 0.50 | — | — |
| | 19 | 0.010 | 0.20 | 0.97 | 0.012 | 0.004 | 12.2 | 2.5 | 0.021 | 0.003 | 0.25 | — | — | — | — |
| | 20 | 0.010 | 0.20 | 0.97 | 0.012 | 0.004 | 16.3 | 2.45 | 0.019 | 0.003 | 0.26 | — | — | — | — |
| | 21 | 0.010 | 0.20 | 0.99 | 0.013 | 0.004 | 18.5 | 2.59 | 0.019 | 0.004 | 0.25 | — | — | — | — |
| Comparison | 22 | 0.009 | 0.50 | 0.34 | 0.005 | 0.003 | 10.7 | — | 0.038 | — | 0.32 | — | — | — | — |
| | 23 | 0.021 | 0.45 | 0.48 | 0.014 | 0.005 | 11.8 | — | 0.043 | — | — | — | — | — | — |
| | 24 | 0.018 | 0.43 | 0.14 | 0.020 | 0.002 | 19.44 | — | 0.018 | — | — | 0.40 | — | 0.35 | — |
| | 25 | 0.007 | 0.32 | 0.12 | 0.030 | 0.007 | 18.90 | 1.95 | — | — | 0.25 | 0.21 | — | — | — |

| | | V | Zr | Ca | Ce | Pitting initiation potential(A) (mV vs SCE) | Max depth(B) (μm) |
|---|---|---|---|---|---|---|---|
| Invention | 1 | — | — | — | — | +220 | 20 |
| | 2 | — | — | — | — | +235 | 18 |
| | 3 | — | — | — | — | +240 | 15 |
| | 4 | — | — | — | — | +251 | 13 |
| | 5 | — | — | — | — | +250 | 14 |
| | 6 | — | — | — | — | +251 | 13 |
| | 7 | — | — | — | — | +250 | 13 |
| | 8 | — | — | — | — | +251 | 14 |
| | 9 | — | — | — | — | +250 | 13 |
| | 10 | — | — | — | — | +250 | 13 |
| | 11 | 0.50 | — | — | — | +249 | 13 |
| | 12 | — | 0.51 | — | — | +248 | 13 |
| | 13 | — | — | — | — | +249 | 14 |
| | 14 | 0.31 | — | — | — | +249 | 13 |
| | 15 | — | — | 0.020 | — | +251 | 13 |
| | 16 | — | — | 0.030 | — | +248 | 15 |
| | 17 | — | — | 0.021 | 0.015 | +251 | 13 |
| | 18 | — | — | 0.021 | 0.012 | +255 | 13 |
| | 19 | — | — | — | — | +270 | 13 |
| | 20 | — | — | — | — | +289 | 10 |
| | 21 | — | — | — | — | +310 | 10 |
| Comparison | 22 | — | — | — | — | +175 | 82 |
| | 23 | — | — | — | — | +180 | 78 |
| | 24 | — | — | — | — | +182 | 75 |
| | 25 | — | — | — | — | +250 | 15 |

EXAMPLE 2

For evaluation of the properties of steels produced using an industrially practical production process, equipment identical to that for ordinary steel production was used for producing 0.6 mm stainless steel sheet materials of the chemical compositions shown in Table 2 by tapping from a converter, not rolling pickling, cold rolling, annealing, pickling and temper rolling. The resulting products were subjected to the following tests for property evaluation:

(1) Corrosion test by method A. This was conducted by repeating, over a 28-day period, a series of treatments consisting of salt spray test according to JIS Z 2371 for 6 hours, exposure to a 70° C. warm air stream for 4 hours, standing at a temperature of 49° C. and a relative humidity of 98% for 4 hours, and freezing at −20° C. for 4 hours. At the end of the 28 days the corrosion depth was then measured. It was considered that a product exhibiting anticorrosion property capable of providing a muffler with a service life of around 5 years would incur corrosion to a depth of not more than 0.10 mm.

(2) Corrosion test by method B. This was conducted by a 4-day salt spray test according to JIS Z 2371 using a 0.5% NaCl+0.2% $H_2O_2$ solution. The degree of corrosion was evaluated on a scale of A (excellent) to F (bad) and, for reasons similar to those in Test (1), the products of ranks A to C were considered satisfactory.

(3) Corrosion test by method C. This was conducted by first IG-welding the product and then subjecting i to stainless steel copper sulfate-sulfuric acid test for 16 days, followed by bending at an inner surface bending radius of 0.3 mm. The welded and heat-affected portions of the outer surface were then observed for the presence of intergranular cracking. For reasons similar to those in Test (1), it was considered that no cracking should be observed.

(4) Tensile test. The 0.2% yield strength and elongation were observed. A 0.2% yield strength of not more than 30 kgf/mm$^2$ and an elongation of not more than 30% were considered necessary for enabling production using an ordinary steel line and for adequate workability as a sheet or pipe.

(5) Lankford value test. It was considered that an $\bar{r}$ value of not less than 1.50 was necessary from the point of sheet and pipe workability.

(6) Secondary workability test. This was conducted by subjecting the product to working by cold rolling from a sheet thickness of 0.6 mm to 0.42 mm, subjecting it to tight bending such that the crease would run parallel to the rolling direction and then evaluating the degree of cracking on a scale of 1 (no cracking) to 6 (severe cracking). It was considered that a rank of 1 or 2 was necessary from the point of sheet and pipe workability.

TABLE 2

| | Composition (wt %) | | | | | | | | | | | | Pitting Initiation | Max |
|---|---|---|---|---|---|---|---|---|---|---|---|---|---|---|
| No | C | Si | Mn | P | S | Ni | Cr | Mo | Ti | Al | N | Ti C + N | Potential(A) (mV vs SCE) | depth(B) (μm) |
| 1 | 0.009 | 0.02 | 0.11 | 0.023 | 0.002 | 0.07 | 17.53 | 1.09 | 0.23 | 0.063 | 0.0084 | 13.2 | +245 | 14 |
| 2 | 0.006 | 0.18 | 0.10 | 0.027 | 0.003 | 0.08 | 17.48 | 1.22 | 0.20 | 0.048 | 0.0071 | 15.3 | +255 | 13 |
| 3 | 0.007 | 0.08 | 0.07 | 0.018 | 0.001 | 0.07 | 17.77 | 1.16 | 0.16 | 0.061 | 0.0082 | 10.7 | +249 | 12 |
| 4 | 0.010 | 0.05 | 0.16 | 0.020 | 0.004 | 0.09 | 17.51 | 1.14 | 0.38 | 0.095 | 0.0125 | 16.9 | +251 | 13 |
| 5 | 0.008 | 0.011 | 0.12 | 0.025 | 0.001 | 0.08 | 16.67 | 1.47 | 0.27 | 0.055 | 0.0087 | 16.2 | +250 | 11 |
| 6 | 0.009 | 0.03 | 0.09 | 0.021 | 0.004 | 0.13 | 19.34 | 1.13 | 0.31 | 0.088 | 0.0073 | 19.0 | +300 | 10 |
| 7 | 0.010 | 0.03 | 0.10 | 0.022 | 0.002 | 0.08 | 17.43 | 1.06 | 0.24 | 0.008 | 0.0078 | 13.5 | +244 | 14 |
| 8 | 0.008 | 0.04 | 0.10 | 0.020 | 0.003 | 0.07 | 17.41 | 1.02 | 0.13 | 0.074 | 0.0096 | 7.4 | +245 | 14 |
| 9 | 0.008 | 0.54 | 0.09 | 0.024 | 0.001 | 0.09 | 17.55 | 1.11 | 0.21 | 0.048 | 0.0078 | 13.3 | +245 | 13 |
| 10 | 0.009 | 0.16 | 0.14 | 0.021 | 0.002 | 0.10 | 17.58 | 1.08 | 0.52 | 0.066 | 0.0083 | 30.1 | +246 | 14 |

Productivity and target product properties

| | Product properties* | | | | | | | |
|---|---|---|---|---|---|---|---|---|
| | Corrosion prop. | | | Workability | | | | |
| No | 1 | 2 | 3 | 4 | 5 | 6 | 7 | |
| 1 | 0.07 | B | No | 28.1 | 32.2 | 1.91 | 1 | INVENTION |
| 2 | 0.07 | B | " | 29.3 | 30.6 | 1.88 | 1 | |
| 3 | 0.06 | B | " | 28.8 | 31.2 | 1.89 | 1 | |
| 4 | 0.08 | B | " | 28.6 | 31.5 | 1.90 | 1 | |
| 5 | 0.09 | B | " | 28.4 | 31.8 | 1.93 | 1 | |
| 6 | 0.03 | B | " | 29.5 | 30.3 | 1.83 | 1 | |
| 7 | 0.06 | B | No | 28.3 | 32.0 | 1.75 | 1 | |
| 8 | 0.07 | B | Yes | 28.5 | 31.7 | 1.87 | 1 | COMP |
| 9 | 0.06 | B | No | 35.2 | 27.1 | 1.78 | 2 | |
| 10 | 0.08 | B | " | 29.7 | 30.1 | 1.86 | 5 | |
| | ≦0.10 | ≧C | No | ≦30.0 | ≧30.0 | ≧1.50 | ≦2 | |

*Legend to product properties.
1 Corrosion depth (mm)
2 Degree of corrosion
3 Intergranular corrosion
4 0.2% yield strength (kgf/mm$^2$)
5 Elongation (%)
6 F value
7 Workability rank As can be seen from Table 1, all of the steels in accordance with the present invention were superior to the comparison steels in both pitting initiation property and pitting depth. Further it can be seen from the results of the examples in Table 2, in which industrial scale production equipment was used, that the steel according to this invention excels in both anticorrosion property and workability. From this it will be understood that stainless steel in accordance with this invention exhibits superior, long-term corrosion resistance in a harsh condensate environment such as an engine exhaust gas environment, and also possesses outstanding workability and, as such, has very high practical utility.

What is claimed is:

1. A stainless steel exhibiting excellent anticorrosion property for use in engine exhaust systems comprising, as expressed in wt %, not more than 0.010% C,
not more than 0.2% Si,
not less than 0.05% and not more than 1.5% Mn,
not less than 12% and not more than 20.0% Cr,
not less than 0.2% and not more than 3.0% Mo,
not less than 0.005% and not more than 0.1% Al,
not more than 0.015% N,
not more than 0.025% P,
not more than 0.010% S, either
not less than 10×(C%+N%) and not more than 0.5% Ti, or said amount of Ti and
not less than 5×(C%+N%) and not more than 0.5% Nb, and the balance of Fe and unavoidable impurities.

2. A stainless steel exhibiting excellent anticorrosion property for use in engine exhaust systems according to claim 1, further comprising one or more of not less than 0.1% and not more than 1.0% Ni,
not less than 0.03% and not more than 1.0% Cu,
not less than 0.05% and not more than 0.5% W,
not less than 0.05% and not more than 0.5% V, and
not less than 0.05% and not more than 1.0% Zr.

3. A stainless steel exhibiting excellent anticorrosion property for use in engine exhaust systems according to claim 1, further comprising one or both of not less than 0.001% and not more than 0.03% Ca and
not less than 0.001% and not more than 0.03% Ce.

4. A stainless steel exhibiting excellent anticorrosion property for use in engine exhaust systems according to claim 2, further comprising one or both of not less than 0.001% and not more than 0.03% Ca and not less than 0.001% and not more than 0.03% Ce.

5. A stainless steel exhibiting excellent anticorrosion property for use in engine exhaust systems comprising, as expressed in wt %, not more than 0.010% C,
not more than 0.2% Si,
not less than 0.05% and not more than 1.5% Mn,
not less than 12% and not more than 20.0% Cr,
not less than 0.2% and not more than 3.0% Mo,
not less than 0.005% and not more than 0.1% Al,
not more than 0.015% N,
not more than 0.025% P,
not more than 0.010% S,
not less than $5\times(C\%+N\%)$ and not more than 0.5% Nb, one or more of not less than 0.1% and not more than 1.0% Ni,
not less than 0.03% and not more than 1.0% Cu,
not less than 0.05% and not more than 0.5% W,
not less than 0.05% and not more than 0.5% V, and
not less than 0.05% and not more than 1.0% Zr, and the balance of Fe and unavoidable impurities.

6. A stainless steel exhibiting excellent anticorrosion property for use in engine exhaust systems according to claim 5, further comprising one or both of not less than 0.001% and not more than 0.03% Ca and
not less than 0.001% and not more than 0.03% Ce.

7. A stainless steel exhibiting excellent anticorrosion property for use in engine exhaust systems according to claim 1, further comprising one or both of not less than 0.001% and not more than 0.03% Ca and
not less than 0.012% and not more than 0.03% Ce.

8. A stainless steel exhibiting excellent anticorrosion property for use in engine exhaust systems according to claim 2, further comprising one or both of not less than 0.001% and not more than 0.03% Ca and
not less than 0.012% and not more than 0.03% Ce.

9. A stainless steel exhibiting excellent anticorrosion property for use in engine exhaust systems according to claim 5, further comprising one or both of not less than 0.001% and not more than 0.03% Ca and
not less than 0.012% and not more than 0.03% Ce.

* * * * *